US008975000B2

(12) United States Patent
Tani et al.

(10) Patent No.: US 8,975,000 B2
(45) Date of Patent: Mar. 10, 2015

(54) METHOD OF PRODUCING POLYMERIZED TONER, METHOD OF PRODUCING BINDER RESIN FOR TONER, AND TONER

(75) Inventors: Atsushi Tani, Suntou-gun (JP); Norikazu Fujimoto, Susono (JP); Hitoshi Itabashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/178,971

(22) Filed: Jul. 24, 2008

(65) Prior Publication Data

US 2008/0286675 A1 Nov. 20, 2008

Related U.S. Application Data

(63) Continuation of application No. PCT/JP2008/054375, filed on Mar. 11, 2008.

(30) Foreign Application Priority Data

Mar. 12, 2007 (JP) ..... 2007-062110

(51) Int. Cl.
*G03G 9/087* (2006.01)
*G03G 9/08* (2006.01)

(52) U.S. Cl.
CPC ..... *G03G 9/0806* (2013.01); *G03G 9/08702* (2013.01)
USPC ..... 430/137.15; 430/105

(58) Field of Classification Search
USPC ..... 430/105, 137.15
See application file for complete search history.

(56) References Cited

U.S. PATENT DOCUMENTS

| | | | | |
|---|---|---|---|---|
| 4,525,308 | A | 6/1985 | Sanchez | |
| 4,634,753 | A | 1/1987 | Sanchez | 526/216 |
| 5,001,197 | A | 3/1991 | Hendewerk | 525/285 |
| 5,051,531 | A * | 9/1991 | Sanchez | 560/302 |
| 2003/0232240 | A1* | 12/2003 | Lee et al. | 429/122 |
| 2006/0172221 | A1* | 8/2006 | Kurokawa | 430/137.15 |
| 2007/0048645 | A1 | 3/2007 | Takashima et al. | |
| 2007/0257238 | A1* | 11/2007 | Misura et al. | 252/586 |
| 2009/0076234 | A1* | 3/2009 | Grimaldi et al. | 526/230.5 |

FOREIGN PATENT DOCUMENTS

| | | |
|---|---|---|
| EP | 0 126 216 A2 | 11/1984 |
| JP | 61-114245 | 5/1986 |
| JP | 07-181731 | 7/1995 |
| JP | 07-258315 | 10/1995 |
| JP | 07-258316 | 10/1995 |
| JP | 10-020548 | 1/1998 |
| JP | 2005-106939 | 4/2005 |
| JP | 2006-106198 | 4/2006 |

OTHER PUBLICATIONS

European Search Report dated Jan. 23, 2013 in European Application No. 08721791.5.

Partial English-Language translation of Japanese Office Action dated Nov. 4, 2009 counterpart application No. 2009-504057—3 pages.

* cited by examiner

*Primary Examiner* — Peter Vajda

(74) *Attorney, Agent, or Firm* — Fitzpatrick, Cella, Harper and Scinto

(57) ABSTRACT

The method of producing polymerized toner, the method including: dispersing a polymerizable monomer composition containing at least a polymerizable monomer and a colorant in an aqueous medium; and polymerizing the polymerizable monomer in the aqueous medium with a polymerization initiator to produce toner particles, and is characterized in that a polymerization initiator which has a specific structure and the hydrogen bond dissociation energies of which satisfy specific relationships is used as the polymerization initiator.

4 Claims, No Drawings

METHOD OF PRODUCING POLYMERIZED TONER, METHOD OF PRODUCING BINDER RESIN FOR TONER, AND TONER

FIELD OF THE INVENTION

The present invention relates to a toner to be used for visualizing an electrostatic latent image formed by a method such as an electrophotographic method, an electrostatic recording method, a magnetic recording method, or a toner jet type recording method, and a method of producing the toner.

BACKGROUND OF THE INVENTION

Various methods have been known as image-forming methods each of which is based on an electrophotographic method. A general image-forming method is as described below. A photoconductive substance is utilized so that an electrostatic latent image is formed on an electrostatic image bearing member (which may hereinafter be referred to as "photosensitive member") with various means. Next, the electrostatic latent image is developed with toner to be turned into a visible image, and the visible image formed with the toner is transferred onto a recording medium such as paper as required. After that, the visible image is fixed as a toner image onto the recording medium with heat or pressure, whereby a copied article is obtained. An image-forming apparatus for use in such method is, for example, a printer or a copying machine.

In recent years, LED laser beam printers have gone mainstream in the market of printer apparatuses, and there has been a trend toward an increase in resolution: although conventional printer apparatuses each have a resolution of at most, for example, 300 dpi or 400 dpi, the LED laser beam printers each have a resolution as high as, for example, 600 dpi or 1,200 dpi. In association with the increase in resolution, definition requested of a developing system has been growing. In addition, as in the case of a printer, a high-resolution, high-definition developing system has been requested also of a copying machine because the functions of the copying machine have become more and more sophisticated by virtue of digitization.

In ordinary cases, toner to be used in such printer or copying machine is a mixture of fine particles each mainly composed of a binder resin and a colorant such as a dye, a pigment, carbon black, or a magnetic substance, and fine particles to be used in the toner each have a particle diameter of about 5 to 30 μm.

The toner is generally produced by the so-called pulverization method involving: melting the above colorant, and, as required, a charge control agent, a wax, and the like; mixing the molten product in a thermoplastic resin as the binder resin to disperse the molten product uniformly in the resin; finely pulverizing the resin composition thus obtained; and classifying the finely pulverized products to provide particles each having a desired particle diameter. A requirement that the above components should satisfy in the toner production is, for example, as follows: the above resin composition must be so sufficiently brittle as to be finely pulverized with an economical production apparatus. However, an increase in brittleness of the resin composition involves the following problem: the particle diameters of the particles obtained by finely pulverizing the resin composition are apt to cover a wide range. In addition, even after the particles have been turned into toner, the particles are apt to be additionally reduced in size during the use of the toner in a developing device, so the following problem also arises: a reduction in developing performance of the toner is caused by the exposure of the colorant to the broken-out section of a toner particle.

Meanwhile, a method of producing polymerized toner based on a suspension polymerization method has been proposed with a view to overcoming such problems of the toner by the pulverization method. The suspension polymerization method involves: dissolving or dispersing, in a polymerizable monomer, a colorant, and, as required, any other substance that needs to be incorporated into a toner particle such as a polyfunctional monomer, a chain transfer agent, a charge control agent, or a wax to prepare a polymerizable monomer composition; suspending, in an aqueous medium containing a dispersion stabilizer, the polymerizable monomer composition together with a polymerization initiator; and polymerizing the polymerizable monomer composition by a method such as heating to provide toner particles each having a desired particle diameter. Since the method does not involve any pulverizing step, a resin material does not need to have brittleness, and even a soft resin material can be used. In addition, the colorant is hardly exposed to the surface of a toner particle, so toner particles each of which: has uniform triboelectric chargeability; and is excellent in durability can be obtained. Further, a classifying step can be omitted, so a reducing effect on a cost for the production of the toner particles is improved because of, for example, energy savings, the shortening of a time period required for the production of the toner particles, and an increase in yield in which the toner particles are produced.

However, carbon black, and some dyes and pigments each of which is used as the above colorant are apt to inhibit a polymerization reaction. In addition, in polymerized toner produced by the suspension polymerization method or a resin produced by the suspension polymerization method, an unreacted polymerizable monomer may remain in a toner particle or resin particle depending on the kind of the polymerization initiator to be used. When the amount of the remaining polymerizable monomer becomes excessively large, the charge quantities of the individual toner particles become nonuniform, so fogging is apt to occur. In addition, the contamination of a toner carrying member or filming to a photosensitive member is apt to occur, so the following problem arises: a reduction in quality of an image formed with the toner occurs.

In addition, the efficiency with which the polymerization initiator is utilized in the suspension polymerization method is not always sufficient, and part of the molecules of the polymerization initiator may remain as a decomposition product residue in a toner particle or resin without being involved in a polymerization reaction. The decomposition product residue is produced as a result of, for example, the following behavior: free radicals (radicals) produced by the decomposition of the polymerization initiator each abstract a hydrogen atom from any other compound in a reaction system, or the radicals are disproportionated or recombine with each other. The decomposition product residue is mainly a compound such as an alcohol, a carboxylic acid, or a hydrocarbon. Of those decomposition products, a decomposition product having a low boiling point can be removed by distillation by performing an operation such as heating or decompression after polymerization, and a decomposition product having water-solubility can be eluted in the aqueous medium. However, it becomes difficult to remove a compound which: has a relatively high molecular weight; has a high boiling point; and is hardly soluble in water, and the compound remains in a toner particle.

Such decomposition product residue is also responsible for a reduction in charging stability of toner and a reduction in quality of an image formed with the toner during the long-term use of the toner. In addition, at the time of fixation, molten toner is apt to adhere to a heat roller, and the adhesion is one cause for the so-called hot offset in which a sheet to which an image is fixed is contaminated. In addition, a reduction in efficiency with which the polymerization initiator is utilized due to the production of a large amount of such decomposition product causes an increase in amount of an unreacted polymerizable monomer.

Investigation on a method of preventing an unreacted polymerizable monomer or a decomposition product residue derived from a polymerization initiator from remaining in a toner particle has been vigorously conducted so far, and such various methods as exemplified below have been proposed.

For example, the following method has been proposed (see Patent Document 1): a resin for toner in which the amount of the decomposition-product residue of a polymerization initiator is reduced is produced by using a peroxide having a specific structure and having a 10-hour half life temperature of 120° C. or lower as the polymerization initiator.

In addition, the following method has been proposed (see Patent Document 2): a resin for toner in which the remaining of an unreacted monomer (polymerizable monomer) is suppressed is obtained by performing polymerization in the coexistence of a polymerization initiator having another specific structure different from that of the above polymerization initiator and having a 10-hour half life temperature of 70° C. or higher, and any other polymerization initiator.

Further, the following method has been proposed (see Patent Document 3): a polymerized toner in which, for example, the amount of the decomposition product of a polymerization initiator or the amount of a remaining monomer (polymerizable monomer) is suppressed is produced by performing suspension polymerization using a non-aromatic organic peroxide having a molecular weight of 250 or less and a 10-hour half life temperature of 60 to 85° C. as a polymerization initiator in the polymerization temperature range of 75 to 100° C. in the production of a polymerized toner for a non-magnetic, one-component developer.

Of the above-mentioned conventional techniques, the method disclosed in Patent Document 1 involves the use of an aliphatic organic peroxide as a polymerization initiator, and an organic peroxide the number of carbon atoms of especially an aliphatic hydrocarbon group of which is limited out of, for example, ordinary peroxycarbonate organic peroxides, monocarbonate organic peroxides, diacyl organic peroxides, and dicarbonate organic peroxides is included in the category of such aliphatic organic peroxide. According to the method, a decomposition product derived from the polymerization initiator has a relatively low molecular weight. Therefore, when a binder resin for toner is produced by a solution polymerization method using the polymerization initiator, a decomposition product residue volatilizes by being heated at a high temperature in a solvent-removing step after polymerization or a melt-kneading step at the time of the preparation of toner, so the remaining of the decomposition product residue in a toner particle can be suppressed. However, when such polymerization initiator is applied to the production of toner by a suspension polymerization method, it is difficult to suppress the remaining of a decomposition product residue in a toner particle because the method does not involve any such step of heating the decomposition product residue at a high temperature as described above. In addition, it is also difficult to suppress the inhibition of polymerization by part of the molecules of a colorant.

In addition, the method disclosed in Patent Document 2 described above involves the use of a polymerization initiator that produces a radical which hardly causes a hydrogen abstraction reaction in the step of producing a binder resin for toner. According to the method, the radical is allowed to be present stably over a long time period, so the efficiency with which a monomer is utilized is improved, and the remaining of an unreacted monomer can be suppressed. However, the polymerization initiator is not always suitable as a polymerization initiator to be used in the production of toner by a suspension polymerization method because of its high 10-hour half life temperature. In addition, it is not true that only a radical which hardly causes a hydrogen abstraction reaction is produced from the polymerization initiator, and any other polymerization initiator must be further used in combination with the above polymerization initiator, so the method disclosed in Patent Document 2 is found to have a small reducing effect on the amount of a decomposition product residue to be produced.

Further, the method disclosed in Patent Document 3 described above specifies the molecular weight and 10-hour half life temperature of a polymerization initiator to be used in the production of polymerized toner by a suspension polymerization method, and intends to suppress the remaining of a decomposition product residue or of an unreacted monomer by means of the specification. However, the physical properties of a decomposition product are not uniquely determined merely by the molecular weight of the polymerization initiator, and are dominated by the molecular weight and molecular structure of the decomposition product itself. In addition, the amount of the unreacted monomer is not determined merely by the 10-hour half life temperature of the polymerization initiator, and depends largely on a balance between the 10-hour half life temperature and a polymerization temperature. In addition, the method intends to suppress the remaining of the decomposition product residue in a toner particle, not to suppress the very production of the decomposition product. According to the investigation conducted by the inventors of the present invention, the method is still susceptible to improvement in terms of the remaining of the decomposition product residue or of the unreacted monomer.

As described above, at present, no production method with which various deficiencies caused by the remaining of an unreacted polymerizable monomer or a decomposition product residue in a toner particle in polymerized toner by a suspension polymerization method can be solved has been obtained yet.

Patent Document 1: JP 61-114245 A
Patent Document 2: JP 07-181731 A
Patent Document 3: JP 3336862 A

SUMMARY OF THE INVENTION

Problems to be Solved by the Invention

An object of the present invention is to provide a polymerized toner that has solved the above-mentioned conventional problems, and a method of producing the toner.

That is, the object of the present invention is to provide a method of producing a polymerized toner which: is affected by a polymerization-inhibiting substance to a small extent; and can improve the efficiency with which a polymerization initiator is utilized.

Another object of the present invention is to provide a method of producing a binder resin for toner or polymerized toner in which the remaining of an unreacted polymerizable monomer or a decomposition product residue derived from a polymerization initiator is suppressed.

Another object of the present invention is to provide a toner excellent in charging stability and capable of providing stable images over a long time period by employing the production method.

Means for Solving the Problems

A method of producing polymerized toner of the present invention, comprising: dispersing a polymerizable monomer composition containing at least a polymerizable monomer and a colorant in an aqueous medium; and polymerizing the polymerizable monomer in the aqueous medium with a polymerization initiator, is characterized in that: the polymerization initiator has a structure represented by the following general formula (I); and when a hydrogen bond dissociation energy per one mole of an alcohol represented by the following general formula (II) produced by decomposition of the polymerization initiator is represented by D1 (kJ/mol), a hydrogen bond dissociation energy per one mole of a compound represented by the following general formula (III) in which $R_1$ in the following general formula (I) and hydrogen are bonded to each other is represented by D2 (kJ/mol), and a hydrogen bond dissociation energy per one mole of a compound represented by the following general formula (IV) in which $R_2$ in the following general formula (I) and hydrogen are bonded to each other is represented by D3 (kJ/mol), D1 to D3 satisfy relationships represented by the following expressions (i) and (ii):

$$D1-D2 \geq 85 \text{ kJ/mol; and} \quad \text{(i)}$$

$$|D2-D3| \leq 30 \text{ kJ/mol;} \quad \text{(ii)}$$

[Chem 1]

General formula (I)

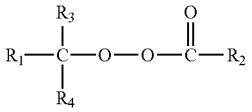

where $R_1$ represents a group obtained by substituting part of hydrogen atoms of a hydrocarbon group having 1 to 6 carbon atoms with hydroxyl groups, $R_2$ represents a hydrocarbon group having 1 to 6 carbon atoms, and $R_3$ and $R_4$ each represent a hydrocarbon group having 1 or 2 carbon atoms.

[Chem 2]

General formula (II)

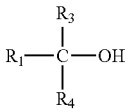

General formula (III)

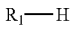

General formula (IV)

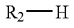

In addition, the polymerized toner of the present invention is characterized by producing by the above production method.

Further, a method of producing a binder resin for toner of the present invention, including a polymerization step including polymerizing a polymerizable monomer with at least a polymerization initiator, is characterized in that: the polymerization initiator has a structure represented by the above general formula (I); and when a hydrogen bond dissociation energy per one mole of an alcohol represented by the above general formula (II) produced by decomposition of the polymerization initiator is represented by D1 (kJ/mol), a hydrogen bond dissociation energy per one mole of a compound represented by the above general formula (III) in which $R_1$ in the above general formula (I) and hydrogen are bonded to each other is represented by D2 (kJ/mol), and a hydrogen bond dissociation energy per one mole of a compound represented by the above general formula (IV) in which $R_2$ in the above general formula (I) and hydrogen are bonded to each other is represented by D3 (kJ/mol), D1 to D3 satisfy relationships represented by the above expressions (i) and (ii).

In addition, the toner of the present invention is characterized by containing a binder resin for toner produced by the above production method.

Effects of the Invention

According to the present invention, in the production of polymerized toner or a binder resin for toner, an influence by a polymerization-inhibiting substance can be eliminated, and the efficiency with which a polymerization initiator is utilized can be improved. As a result, there can be provided a production method with which the remaining of an unreacted polymerizable monomer or a decomposition product residue derived from the polymerization initiator in a toner particle can be suppressed.

In addition, there can be provided a polymerized toner excellent in charging stability and capable of providing stable images over a long time period by employing the production method.

BEST MODE FOR CARRYING OUT THE INVENTION

Hereinafter, the present invention will be described in more detail by way of a preferred embodiment of the present invention.

The inventors of the present invention have found that a polymerization initiator having a specific structure hardly undergoes polymerization inhibition by a colorant in the production of polymerized toner including the polymerization step including dispersing a polymerizable monomer composition containing a polymerizable monomer and the colorant in an aqueous medium, and polymerizing the polymerizable monomer in the aqueous medium with a polymerization initiator.

Further, the inventors have found that the optimization of the constitution of the polymerization initiator can: significantly improve the efficiency with which the polymerization initiator is utilized; and suppress the remaining of an unreacted monomer or a decomposition product residue in a toner particle. The inventors have completed the present invention with those findings. In addition, an improvement in efficiency with which the polymerization initiator is utilized is effective also for the production of a binder resin for toner.

A representative method of producing the above-mentioned polymerized toner is, for example, a suspension polymerization method. The suspension polymerization method is a method involving: suspending, in an aqueous medium containing a dispersion stabilizer, a polymerizable monomer composition obtained by adding a polymerization initiator, and, as required, a polyfunctional monomer, a chain transfer agent, or the like to a polymerizable monomer; to produce granulated products; and subjecting the granulated products to polymerization under heat. According to the method, toner particles can be directly produced by performing the polymerization after dissolving or dispersing, in the polymerizable monomer composition, a colorant and any other substance that needs to be incorporated into a toner particle in advance.

Polymerized toner by the suspension polymerization method is produced as described below.

First, components including at least a colorant are added to a polymerizable monomer serving as a toner composition, that is, a binder resin. The components are uniformly dissolved or dispersed in the polymerizable monomer with a dispersing machine such as a homogenizer, a ball mill, a colloid mill, or an ultrasonic dispersing machine, whereby a polymerizable monomer composition is prepared. At that time, for example, a polyfunctional monomer or a chain transfer agent, a wax as a release agent, a charge control agent, a plasticizer, and, furthermore, any other additive such as a high-molecular-weight polymer or a dispersant can each be appropriately added into the above polymerizable monomer composition.

Next, the above polymerizable monomer composition is suspended in a previously prepared aqueous medium containing a dispersion stabilizer, to produce granulated products. At that time, the grain size distribution of toner particles to be obtained can be sharpened by granulating the suspension into particles each having a desired particle size in one stroke with a high-speed dispersing machine such as a high-speed stirring machine or an ultrasonic dispersing machine.

A polymerization initiator may be mixed with any other additive upon preparation of the polymerizable monomer composition, or may be mixed in the polymerizable monomer composition immediately before the suspension of the polymerizable monomer composition in the aqueous medium. Alternatively, the polymerization initiator can be added in a state of being dissolved in the polymerizable monomer or any other solvent as required during the granulation or after the completion of the granulation, that is, immediately before the initiation of a polymerization reaction.

The polymerization reaction is performed while the temperature of the suspension after the granulation is increased to 50 to 90° C., and the suspension is stirred so that the droplet particles of the suspension each maintain a particle state, and the particles undergo neither floating nor sedimentation.

The polymerization initiator easily decomposes by heating as a result of the temperature increase so as to produce a free radical (radical).

The produced radical is added to an unsaturated bond of one molecule of the polymerizable monomer, whereby a radical of an adduct is newly produced. Then, the produced radical of the adduct is further added to an unsaturated bond of another molecule of the polymerizable monomer. The polymerization reaction advances by the chain repetition of such addition reactions.

In the latter half of the polymerization reaction or after the completion of the polymerization reaction, part of the aqueous dispersion medium can be removed by distillation from a reaction system in order that an unreacted polymerizable monomer or a by-product may be removed.

Then, after the completion of the polymerization reaction, the resultant polymer particles are filtrated by a known method, sufficiently washed, and dried. Thus, the polymerized toner by the suspension polymerization method is obtained.

In general, the inhibition of the polymerization reaction is caused by the presence of a substance that extremely easily reacts with each of the radicals produced by the decomposition of the polymerization initiator (polymerization-inhibiting substance) in the reaction system. Since part of the molecules of the colorant each serve as a polymerization-inhibiting substance, in the presence of such colorant, a direct reaction between each of the radicals and the colorant is dominant over the addition reaction of each of the radicals to an unsaturated bond of the polymerizable monomer, and most of the produced radicals are consumed in the direct reaction, with the result that the polymerization inhibition occurs.

The inventors have found that the use of a peroxyester organic peroxide having a structure represented by a general formula (I) as a polymerization initiator in the production of polymerized toner allows one to avoid such polymerization inhibition.

[Chem 3]

General formula (I)

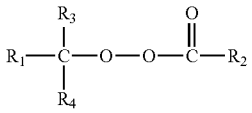

(In the formula, $R_1$ represents a group obtained by substituting part of hydrogen atoms of a hydrocarbon group having 1 to 6 carbon atoms with hydroxyl groups, $R_2$ represents a hydrocarbon group having 1 to 6 carbon atoms, and $R_3$ and $R_4$ each represent a hydrocarbon group having 1 or 2 carbon atoms).

As shown in the following formula (iii), heating the peroxyester organic peroxide results in the cleavage of the O—O bond to produce two kinds of radicals having different structures (an alkoxy radical and an acyloxy radical). The avoidance of the polymerization inhibition is probably attainable on the basis of a difference in reaction activity for a polymerization-inhibiting substance between those two kinds of radicals. That is, by virtue of the presence of one radical species that shows higher activity for the polymerization-inhibiting substance, the other radical species that is more inert against the polymerization-inhibiting substance may be able to contribute to a reaction with the polymerizable monomer without being affected by the polymerization-inhibiting substance.

[Chem 4]

Formula (iii)

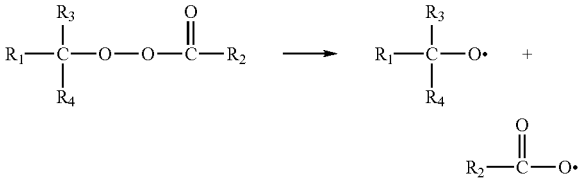

In contrast, a polymerization initiator that produces radicals of a single structure by the cleavage of its O—O bond such as a diacyl organic peroxide or a dicarbonate organic peroxide may be easily affected by a polymerization-inhibiting substance. Although a monocarbonate organic peroxide produces radicals having different structures, the monocarbonate organic peroxide is not a preferable initiator to be used in the production of toner by a suspension polymerization method because the 10-hour half life temperature of the monocarbonate organic peroxide is high, specifically, 90° C. or higher.

In addition, unless a radical produced by the decomposition of the polymerization initiator is effectively utilized, the radical is deactivated in the long run so as to serve as a decomposition product residue. In particular, when a peroxyester organic peroxide is used as the polymerization initiator, it is difficult to improve the efficiency with which the polymerization initiator is utilized, and the amount of a decomposition product residue that does not contribute to the polymerization reaction to be produced tends to be large as compared to that in the case of a diacyl organic peroxide or a dicarbonate organic peroxide. When a large amount of a decomposition product residue remains in the toner, a reduction in charging stability of the toner, a reduction in quality of an image formed with the toner during the long-term use of the toner, and the fixation failure of the image occur.

The inventors have found that, in the present invention, the efficiency with which the peroxyester polymerization initiator is utilized depends on a difference in stability between radicals having different structures to be produced by the decomposition of the peroxyester polymerization initiator, and the efficiency can be improved by optimizing the structures of the radicals.

Known general reactions of the alkoxy radical are the cleavage reaction of a C—C bond at β-position of an oxygen atom shown in the following formula (Iv) (hereinafter referred to as "β cleavage") and a reaction for abstracting a hydrogen atom from the reaction system shown in the following formula (v).

The β cleavage reaction and the hydrogen abstraction reaction may occur competitively. When the β cleavage reaction occurs, an alkyl radical ($R_1$.) is newly produced, and is added to a polymerizable monomer to contribute to the polymerization reaction. However, when the hydrogen abstraction reaction occurs, an alcohol is produced, so the radical may be deactivated. Then, the alcohol serves as the decomposition product residue of the polymerization initiator.

[Chem 5]

Formula (iv)

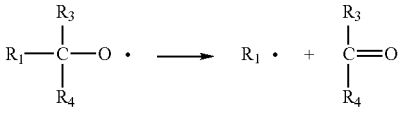

Formula (v)

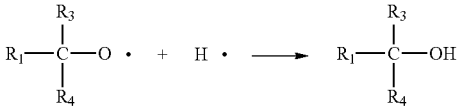

On the other hand, a known general reaction of the acyloxy radical is a decarboxylation reaction shown in the following formula (vi). In addition, when the acyloxy radical abstracts a hydrogen atom from any other compound in the reaction system, a carboxylic acid residue may be produced as shown in the following formula (vii). The hydrogen abstraction reaction hardly occurs as compared to that in the case of the alkoxy radical because the decarboxylation reaction of the acyloxy radical typically advances extremely quickly.

That is, when the peroxyester organic peroxide is used as the polymerization initiator, a radical species that contributes to the polymerization reaction may be an alkyl radical ($R_2$.) produced mainly by the decarboxylation reaction of the acyloxy radical.

[Chem 6]

Formula (vi)

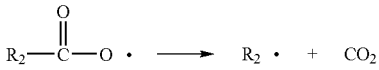

Formula (vii)

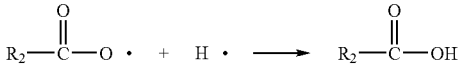

Therefore, the above β cleavage reaction must be caused efficiently in order that the polymerization initiator may be effectively utilized, and the production of a decomposition product residue may be suppressed. The ease with which the β cleavage reaction occurs is improved when comparison between the stability of the alkoxy radical and that of the newly produced alkyl radical ($R_1$.) shows that the stability of the alkyl radical ($R_1$.) is higher than the other.

The stability of the alkyl radical will be described below. For example, an ethyl radical is known to be more stable than a methyl radical, and a primary alkyl, a secondary alkyl, and a tertiary alkyl are known to be arranged in order of decreasing stability as follows: the tertiary alkyl>the secondary alkyl>the primary alkyl. The difference in stability is due to a difference in number of C—H bonds present at β-position of an alkyl radical; the difference in stability may be due to a resonance stabilization effect by the hyperconjugation of hydrogen atoms. Therefore, the ease with which the above β cleavage reaction occurs depends on the structure of the alkyl radical ($R_1$.), and may follow the above-mentioned order.

A quantitative measure for the stability of a radical is, for example, the hydrogen bond dissociation energy. The term "bond dissociation energy" refers to, for example, the minimum energy needed for dissociating a hydrogen bond from a model molecule in a state where a hydrogen atom is added to the above radical. The energy is equal to a value obtained by subtracting the ground state energy of the above model molecule from the sum of the ground state energies of the above radical and the hydrogen atom. Therefore, the smaller value the hydrogen bond dissociation energy shows, the higher the stability of the radical is.

The above bond dissociation energy can be determined by quantum chemical calculation. A semiempirical molecular orbital method is an approach which: intends to determine, for example, the state of a molecule of a compound such as a molecular structure in the ground state or an excited state, and the formation energy, binding energy, highest occupied molecular orbital (HOMO), and lowest unoccupied molecular orbital (LUMO) of the compound by calculation; and has been frequently employed in the field of organic chemistry in recent years.

The value for the hydrogen bond dissociation energy used in the present invention is calculated for a unit model structure obtained by adding a hydrogen atom to each of radical species with a commercially available semiempirical molecular orbital method program (MOPAC93) by an AM1 method.

To be specific, the calculation was performed by using a workstation INDIGO2 (manufactured by Silicon Graphics, Inc.) as a calculator and a Cerius2 as a chemical calculation integrated software.

First, the molecular structure of a compound of interest was produced with a Sketcher function in the Cerius2, and force field calculation and charge calculation were performed for the molecular structure with a DREIDING2.21 program and a CHARGE function, respectively. After that, the structure was optimized by molecular force field calculation on the basis of Minimizer calculation. The resultant structure was optimized by designating an AM1 parameter and Geometry Optimization for the MOPAC93 program, whereby heat of formation (HF1) was calculated.

Next, the same operation was performed for each of a radical structure corresponding to the above compound and a hydrogen atom, and heat of formation (HF2) of the radical structure and heat of formation (HF3) of the hydrogen atom were calculated.

Then, the hydrogen bond dissociation energy (D) (kJ/mol) was calculated in accordance with the following equation.

$$\text{Hydrogen bond dissociation energy}(D)=HF2+HF3-HF1$$

In the present invention, an energy difference (D1−D2) between a hydrogen bond dissociation energy D1 per one mole of the hydrogen adduct of the above alkoxy radical and a hydrogen bond dissociation energy D2 per one mole of the hydrogen adduct of the alkyl radical ($R_1$.) is preferably 85 kJ/mol or more. It should be noted that the theoretical upper limit for the above energy difference (D1−D2) is about 150 kJ/mol.

Then, the inventors have found the following: merely satisfying such condition cannot always improve the efficiency with which the polymerization initiator is utilized, and, when the absolute value for an energy difference (|D2−D3|) between the hydrogen bond dissociation energy D2 per one mole of the hydrogen adduct of the alkyl radical ($R_1$.) and a hydrogen bond dissociation energy D3 per one mole of the hydrogen adduct of the alkyl radical ($R_2$.) is 30 kJ/mol or less in a state where the above condition is satisfied, the efficiency with which the polymerization initiator is utilized is drastically improved, and the production of a decomposition product residue can be significantly suppressed.

This is probably because of the following reason: when there is a large difference in stability between the two kinds of alkyl radicals produced from the alkoxy radical and the acyloxy radical, a reaction for producing the alkyl radical having higher stability becomes dominant over a reaction for producing the alkyl radical having lower stability, and, on the other hand, the abstraction of a hydrogen atom becomes dominant over β cleavage, so the alkoxy radicals cannot be involved in the polymerization.

In addition, when part of the alkoxy radicals abstract hydrogen without undergoing β cleavage, a product must be quickly eluted in the dispersion medium so as to be prevented from remaining in a toner particle. Therefore, from the viewpoint of the solubility of the product in the dispersion medium, $R_1$ in the general formula (I) must represent a group obtained by substituting part of the hydrogen atoms of a hydrocarbon group having 1 to 6 carbon atoms with hydroxyl groups. With such constitution, the product by the abstraction of hydrogen becomes a diol having additionally high water-solubility, so the suppression of the remaining of the product in a toner particle is facilitated.

In addition, $R_1$ in the general formula (I) particularly preferably represents a structure shown in the following general formula (V). This is probably because of the following reason: when a substituent such as a hydroxyl group is bonded to carbon at β-position, the stability of the alkyl radical ($R_1$.) is improved by the resonance effect of the bond, whereby the β cleavage reaction of the original alkoxy radical can be caused with additional effectiveness. In addition, the introduction of a hydroxyl group can reduce the 10-hour half life temperature of the polymerization initiator to be obtained, so the selectivity of components to be combined can be widened. In the general formula (V), at least one of $R_5$ and $R_6$ particularly suitably represents a hydrogen atom.

[Chem 7]

General formula (V)

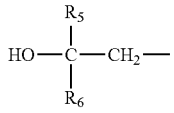

(In the formula, $R_5$ and $R_6$ each represent a hydrogen atom or a hydrocarbon group having 1 to 4 carbon atoms, and a total number of carbon atoms of $R_5$ and $R_6$ is 4 or less).

Meanwhile, in the case of $R_2$ in the general formula (I) as well, part of the acyloxy radicals may abstract hydrogen without undergoing decarboxylation, so the solubility of a carboxylic acid produced by the abstraction in the dispersion medium must be taken into consideration. Therefore, $R_2$ must represent a hydrocarbon group having 1 to 6 carbon atoms.

In addition, when $R_1$ in the general formula (I) represents the structure shown in the above general formula (V), the efficiency with which the polymerization initiator is utilized can be improved most effectively as long as $R_2$ represents a structure shown in a general formula (VI) (secondary alkyl group). In the case of the following structure, an increase in 10-hour half life temperature of the polymerization initiator can be suppressed particularly favorably while the efficiency with which the polymerization initiator is utilized is improved.

[Chem 8]

General formula (VI)

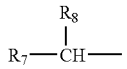

(In the formula, $R_7$ and $R_8$ each represent a hydrocarbon group having 1 to 4 carbon atoms, and a total number of carbon atoms of $R_7$ and $R_8$ is 5 or less).

In the present invention, the 10-hour half life temperature of the polymerization initiator is preferably in the range of 50 to 80° C. When the 10-hour half life temperature falls within the above range, a polymerization temperature can be set within a moderate range, and the molecular weight of a resin to be obtained can be favorably controlled while the efficiency with which the polymerization initiator is utilized is improved and the amount of an unreacted monomer or a decomposition product residue to be produced is suppressed. In addition, when the 10-hour half life temperature is excessively high, a production cost for the resin increases.

Specific examples of the polymerization initiator that satisfies such condition include the following polymerization initiators. For example, there are given 3-hydroxy-1,1-dimethylbutyl peroxyisobutylate, 3-hydroxy-1,1-dimethylbutylperoxy-2-ethylbutylate, 3-hydroxy-1,1-dimethylpropylperoxyisobutylate, 3-hydroxy-1,1-dimethylpropylperoxy-2-ethylbutylate, 3-hydroxy-1,1-dimethylpentylperoxyisobutylate, 3-hydroxy-1,1-dimethylpentylperoxy-2-ethylbutylate, 3-hydroxy-1,1-diethylbutylperoxyisobutylate, 3-hydroxy-1,1-diethylbutylperoxy-2-ethylbutylate, 3-hydroxy-1,1-diethylpropylperoxyisobutylate, 3-hydroxy-1,1-diethylpropylperoxy-2-ethylbutylate, 3-hydroxy-1,1-diethylpentylperoxyisobutylate, 3-hydroxy-1,1-diethylpentylperoxy-2-ethylbutylate, 3-hydroxy-1-methyl- 1-ethylbutylperoxyisobutylate, 3-hydroxy-1-methyl-1-ethylbutylperoxy-2-ethylbutylate, 3-hydroxy-1-methyl-1-ethylpentylperoxyisobutylate, and 3-hydroxy-1-methyl-1-ethylpentylperoxy-2-ethylbutylate.

Of those, in particular, 3-hydroxy-1,1-dimethylbutylperoxyisobutylate, 3-hydroxy-1,1-dimethylbutylperoxy-2-ethylbutylate, 3-hydroxy-1,1-dimethylpropylperoxyisobutylate, and 3-hydroxy-1,1-dimethylpropylperoxy-2-ethylbutylate are suitable.

Then, the polymerization initiator is used in an amount in the range of preferably 0.5 to 20 parts by mass with respect to 100 parts by mass of the polymerizable monomer. When the used amount of the polymerization initiator falls within the above range, the amount of an unreacted monomer or a decomposition product residue to be produced can be suppressed, and the molecular weight of the resin to be obtained can be easily controlled.

As described above, the present invention specifies the structure of the polymerization initiator to be used in the production of polymerized toner or a binder resin for toner from the viewpoint of the stability of a radical to be produced. With the specification, a significant improvement in efficiency with which the polymerization initiator is utilized can be achieved, and the remaining of an unreacted polymerizable monomer or a decomposition product residue in a toner particle can be suppressed. That is, it is difficult to achieve an object of the present invention merely by specifying only the molecular weight (or number of carbon atoms) or 10-hour half life temperature of the polymerization initiator.

As can be seen from the foregoing, according to the present invention, in the production of polymerized toner or a binder resin for toner, an influence by a polymerization-inhibiting substance can be suppressed, and the efficiency with which a polymerization initiator is utilized can be improved. In addition, the remaining of an unreacted monomer or a decomposition product residue derived from the polymerization initiator in a toner particle can be suppressed.

In addition, a polymerized toner excellent in charging stability and capable of providing stable images over a long time period can be realized by employing such production method.

Examples of the polymerizable monomer that can be used in the present invention include the following monomers.

For example, there are given: styrene monomers such as styrene, α-methylstyrene, o-methylstyrene, m-methylstyrene, p-methylstyrene, p-methoxystyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene; acrylates such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate, phenyl acrylate, and 2-hydroxylethyl acrylate; methacrylates such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, 2-hydroxylethyl methacrylate, dimethylaminoethyl methacrylate, and diethylaminoethyl methacrylate; and monomers such as acrylonitrile, methacrylonitrile, and acrylamide.

One kind of those monomers can be used alone, or two or more kinds of them can be used as a mixture. Of those monomers, styrene or a styrene derivative is preferably used alone in terms of the developing performance and durability of the toner; a mixture of styrene or the styrene derivative and any other monomer is also preferably used.

Further, in the present invention, a chain transfer agent may be used as required. Specific examples of the chain transfer agent include: alkyl mercaptans such as n-pentylmercaptan, isopentylmercaptan, 2-methylbutylmercaptan, n-hexylmercaptan, n-heptylmercaptan, n-octylmercaptan, t-octylmercaptan, t-nonylmercaptan, n-dodecylmercaptan, t-dodecylmercaptan, n-tetradecylmercaptan, t-tetradecylmercaptan, n-pentadecylmercaptan, n-hexadecylmercaptan, t-hexadecylmercaptan, and stearylmercaptan; alkyl esters of thioglycol acid; alkyl esters of mercaptopropionic acid; halogenated hydrocarbons such as chloroform, carbon tetrachloride, ethylene bromide, and carbon tetrabromide; and α-methylstylene dimer.

None of those chain transfer agents needs to be necessarily used; when any one of the chain transfer agents is used, the agent is added in an amount of preferably 0.05 to 3 parts by mass with respect to 100 parts by mass of the polymerizable monomer.

In addition, in the present invention, a small amount of a polyfunctional monomer can be used in combination with the essential ingredients. A compound having two or more polymerizable double bonds is mainly used as the polyfunctional monomer. Examples of such compound include: aromatic divinyl compounds such as divinylbenzene and divinylnaphthalene; carboxylates each having two double bonds such as ethylene glycol diacrylate, ethylene glycol dimethacrylate, and 1,3-butanediol dimethacrylate; divinyl compounds such as divinylaniline, divinyl ether, divinyl sulfide, and divinyl sulfone; and compounds each having three or more vinyl groups.

None of those polyfunctional monomers needs to be necessarily used; when any one of the polyfunctional monomers is used, the monomer is added in an amount of preferably 0.01 to 1 part by mass with respect to 100 parts by mass of the polymerizable monomer.

In a suspension polymerization method, a known surfactant, organic dispersant, or inorganic dispersant can be used as a dispersion stabilizer to be added to an aqueous medium. Of those, the inorganic dispersant can be suitably used because the inorganic dispersant hardly produces an ultrafine powder, hardly loses its stability even when a polymerization temperature is changed, can be easily washed, and hardly exerts an adverse effect on the toner. Examples of such inorganic dispersant include: phosphates of polyvalent metals such as calcium phosphate, magnesium phosphate, aluminum phosphate, and zinc phosphate; carbonates such as calcium carbonate and magnesium carbonate; inorganic salts such as calcium metasilicate, calcium sulfate, and barium sulfate; and inorganic oxides such as calcium hydroxide, magnesium hydroxide, aluminum hydroxide, silica, bentonite, and alumina.

When any one of those inorganic dispersants is used, the inorganic dispersant may be added as it is into the aqueous medium before use; in order that additionally fine particles may be obtained, the particles of the inorganic dispersant to be used can be produced in the aqueous medium by using a compound capable of producing the inorganic dispersant. For example, in the case of calcium phosphate, calcium phosphate, which is hardly water-soluble, can be produced by mixing an aqueous solution of sodium phosphate and an aqueous solution of calcium chloride under high-speed stirring, and dispersion with additional uniformity and additional fineness can be achieved. At that time, sodium chloride, which is water-soluble, is simultaneously produced as a by-product, and the presence of a water-soluble salt in the aqueous medium is additionally convenient because the dissolution of the polymerizable monomer in water is suppressed, and the ease with which emulsified fine particles are produced is reduced. The inorganic dispersant can be nearly completely removed by adding an acid or an alkali after the completion of polymerization to dissolve the inorganic dispersant.

In addition, it is preferable that the inorganic dispersant to be used at a concentration of 0.2 to 20 parts by mass with respect to 100% by mass of the polymerizable monomers. However, if required, 0.001 to 0.1 parts by mass of a surfactant may be used in combination. Examples of the surfactant include sodium dodecyl benzene sulfate, sodium tetradecyl sulfate, sodium pentadecyl sulfate, sodium octyl sulfate, sodium oleate, sodium laurate, sodium stearate, and potassium stearate.

As the colorant used in the present invention, known colorants may be used.

Examples of a black colorant include carbon black and a magnetic powder. In addition, those may be toned to black by using the yellow/magenta/cyan colorant described below in combination.

Examples of the yellow colorant to be used include: compounds typified by a condensed azo compound, an isoindolinone compound, an anthraquinone compound, an azo metal complex, a methine compound, and an allylamide compound. To be specific, C.I. Pigment Yellow 12, 13, 14, 15, 17, 62, 74, 83, 93, 94, 95, 109, 110, 111, 128, 129, 147, 168, 180, or the like is suitably used.

Examples of the magenta colorant to be used include: a condensed azo compound, a diketopyrrolopyrrole compound, anthraquinone, a quinacridone compound, a basic dye lake compound, a naphthol compound, a benzimidazolone compound, a thioindigo compound, a perylene compound. To be specific, C.I. Pigment Red 2, 3, 5, 6, 7, 23, 48:2, 48:3, 48:4, 57:1, 81:1, 122, 144, 146, 166, 169, 177, 184, 185, 202, 206, 220, 221, 254, or the like is suitably used.

Examples of the cyan colorant to be used include: a copper phthalocyanine compound and a derivative of the compound; an anthraquinone compound; and a basic dye lake compound. To be specific, C.I. Pigment Blue 1, 7, 15, 15:1, 15:2, 15:3, 15:4, 60, 62, 66, or the like is suitably used.

Each of those colorants can be used alone, or two or more of them can be used as a mixture. Further, each of the colorants can be used in the state of a solid solution. When a magnetic powder is used as the black colorant, the magnetic powder is added in an amount of preferably 40 to 150 parts by mass with respect to 100 parts by mass of the polymerizable monomer. When carbon black is used as the black colorant, carbon black is added in an amount of preferably 1 to 20 parts by mass with respect to 100 parts by mass of the polymerizable monomer. In addition, in the case of a color toner, a colorant is selected in terms of a hue angle, chroma, lightness, weatherability, OHP transparency, and dispersing performance in the toner, and is added in an amount of preferably 1 to 20 parts by mass with respect to 100 parts by mass of the polymerizable monomer.

Attention must be paid to not only the polymerization-inhibiting ability of each of those colorants but also the aqueous phase-migrating performance of each of the colorants, so each of the colorants is preferably subjected to surface modification such as a hydrophobic treatment as required. For example, when a dye colorant is used, the following procedure can be adopted: the polymerizable monomer is polymerized in advance in the presence of the dye, the dye is taken in a resin, and the resultant colored polymer is added to the monomer composition. Carbon black may be subjected to a graft treatment with a substance that reacts with a surface functional group of carbon black such as polyorganosiloxane as well as a treatment similar to that in the case of the above dye.

In addition, the magnetic powder is mainly composed of iron oxide such as triiron tetroxide or γ-iron oxide, and generally has hydrophilicity. Accordingly, the magnetic powder is apt to be unevenly distributed on particle surfaces owing to an interaction with water as a dispersion medium, so the resultant toner particles are each apt to be poor in flowability and uniformity of triboelectric charging owing to the magnetic powder exposed to the surface of each particle. Therefore, the surface of the magnetic powder is preferably subjected to a hydrophobic treatment with a coupling agent in a uniform fashion. A usable coupling agent is, for example, a silane coupling agent or a titanate coupling agent, and the silane coupling agent is particularly suitably used.

The toner preferably contains a release agent to improve fixing performance. Examples of the release agent that can be used include: petroleum waxes such as a paraffin wax, a microcrystalline wax, and petrolatum, and derivatives thereof; a montan wax and derivatives thereof; a hydrocarbon wax according to a Fischer-Tropsch method and derivatives thereof; polyolefin waxes typified by polyethylene and derivatives thereof; and natural waxes such as a carnauba wax and a candelilla wax, and derivatives thereof. Derivatives include oxides, block copolymers with vinyl monomers, and graft modified products. Further, fatty acids such as higher aliphatic alcohols, stearic acid, and palmitic acid or compounds thereof, acid amide waxes, ester waxes, ketones, hydrogenated castor oils and derivatives thereof, plant waxes, animal waxes, and the like can also be used. Those release agents may be used alone or two or more kinds thereof may be used in combination.

Of those release agents, a release agent having the peak top temperature of the highest endothermic peak in the region of 40 to 130° C. at the time of temperature increase in a DSC curve measured with a differential scanning calorimeter is preferable, and a release agent having the peak top temperature of the highest endothermic peak in the region of 45 to 120° C. at the time of temperature increase in the DSC curve is more preferable. Such release agent, if used, can effectively exert releasing performance while contributing to the low-temperature fixing performance of the toner to a large extent. When the peak top temperature of the highest endothermic peak falls within the above range, the exudation of the release agent at any time except fixation can be suppressed, and a reduction in charging performance of the toner can be suppressed. In addition, such release agent allows the toner to achieve compatibility between hot offset resistance and low-temperature fixability favorably. Further, the toner hardly causes deficiencies such as the precipitation of a release agent component during granulation at the time of its production.

The content of the release agent is preferably 1 to 30 parts by mass, or more preferably 3 to 20 parts by mass with respect to 100 parts by mass of a binder resin. When the content of the release agent falls within the above range, a sufficient effect of the addition of the release agent can be obtained, good offset resistance can be obtained, and the long-term storage stability of the toner is improved. In addition, the dispersed state of the release agent in the toner becomes suitable, whereby the flowability and charging performance of the toner can be favorably maintained.

In addition, in the production of the polymerized toner, the polymerization may be performed by adding a resin into the above-mentioned monomer composition. For example, when one wishes to introduce, into the toner, a monomer component containing a hydrophilic group such as an amino group, a carboxyl group, a hydroxyl group, a glycidyl group, or a nitrile group which cannot be used because the component dissolves in an aqueous suspension to cause emulsion polymerization, any such monomer can be used in the form of, for example, a random copolymer, block copolymer, or graft copolymer with a vinyl compound such as styrene or ethylene. Alternatively, the monomer can be used in the form of a polycondensate such as polyester or polyamide, or an addition polymer such as polyether or polyimine.

For example, a polyester resin is a resin containing a large number of ester bonds and having relatively high polarity. When the polymerization is performed by adding the polyester resin into the monomer composition, the polyester resin tends to migrate toward the surface layer of a droplet in the aqueous dispersion medium, so the polyester resin is unevenly distributed to the surface portions of particles with ease in association with the advance of the polymerization. As a result, the resultant toner particles have a uniform surface state and uniform surface composition, so the uniformity of charging of each particle is improved, and the release agent can be favorably incorporated into each toner particle. Therefore, a polymerized toner with additionally good developing performance and additionally good blocking resistance can be obtained.

A saturated polyester resin or an unsaturated polyester resin, or a mixture of both of them can be appropriately selected and used as the polyester resin for controlling the physical properties of the toner such as charging performance, durability, and fixing performance.

A typical polyester resin containing at least an alcohol component and an acid component as constituents can be used as the polyester resin.

Specific examples of the alcohol component include divalent alcohols such as ethylene glycol, 1,2-propylene glycol, 1,3-propylene glycol, 1,4-butanediol, 1,3-butanediol, 2,3-butanediol, diethylene glycol, dipropylene glycol, triethylene glycol, 1,5-pentanediol, 1,6-hexanediol, 1,4-cyclohexanediol, neopentyl glycol, 2,2,4-trimethylpentane-1,3-diol, polyethylene glycol, polypropylene glycol, polytetramethylene glycol, bisphenol A, hydrogenated bisphenol A, the bisphenol derivative represented by the following general formula (VII), or diols represented by the following formula (VIII).

[Chem 9]

General formula (VII)

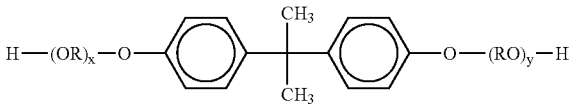

(In the formula, R represents an ethylene or propylene group, x and y each represent an integer of 1 or more, and the average value of x+y is 2 to 10).

[Chem 10]

General formula (VIII)

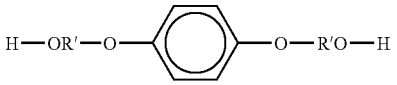

(In the formula, R' represents —$CH_2CH_2$—, —$CH_2CH(CH_3)$—, or —$CH_{12}$—$C(CH_3)_2$—).

In addition, examples of the alcohol component with a valency of 3 or more include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Those alcohol component are used alone or multiple components may be used in combination.

Specific examples of the acid component include dicarboxylic acids such as naphthalene dicarboxylic acid, phthalic acid, isophthalic acid, terephthalic acid, maleic acid, fumaric acid, citraconic acid, itaconic acid, succinic acid, adipic acid, sebacic acid, and azelaic acid; dicarboxylic anhydrides such as phthalic anhydride and maleic anhydride; and lower alkyl esters of dicarboxylic acid, such as dimethyl terephthalate, dimethyl maleate, and dimethyl adipate. Lower alkyl-esters of dicarboxylic acid, such as dimethyl terephthalate, dimethyl maleate, and dimethyl adipate, or derivatives thereof are particularly suitable.

In addition, the acid component may be cross-linked by using a carboxylic acid having 3 or more valences. As a cross-linking component, trimellitic acid, tri-n-ethyl 1,2,4-tricarboxylate, tri-n-butyl 1,2,4-tricarboxylate, tri-n-hexyl 1,2,4-tricarboxylate, triisobutyl 1,2,4-benzenetricarboxylate, tri-n-octyl 1,2,4-benzene tricarboxylate, tri-2-ethylhexyl 1,2,4-benzenetricarboxylate, and lower alkyl-esters of tricarboxylic acid may be used.

Monovalent carboxylic acid components and monovalent alcohol components may be used to such an extent that the characteristics of the polyester resin are not impaired. As the monovalent carboxylic acid, for example, benzoic acid, naphthalene carboxylic acid, salicylic acid, 4-methyl benzoate, 3-methyl benzoate, phenoxy acetate, biphenyl carboxylate, acetic acid, propionic acid, butyric acid, octanoic acid, decanoic acid, dodecanoic acid, stearic acid, and the like may be added. In addition, as the monovalent alcohol component, n-butanol, isobutanol, sec-butanol, n-hexanol, n-octanol, lauryl alcohol, 2-ethylhexanol, decanol, cyclohexanol, and benzylalcohol, dodecyl alcohol may be added.

In addition, a resin except those described above may be added into the monomer composition for the purpose of, for example, improving the dispersibility of a material for the toner, the fixability of the toner, and the characteristics of an image formed with the toner. For example, a homopolymer of styrene or a derivative of styrene such as polystyrene or polyvinyl toluene, or a styrene copolymer can be used alone, or both the copolymers can be used as a mixture.

Further, a polymerized toner having a wide molecular weight distribution and high offset resistance can be obtained by performing polymerization in a state where a polymer having a molecular weight different from the molecular weight range of the binder resin to be obtained by polymerizing the polymerizable monomer is dissolved in the monomer composition in advance.

The addition amount of any such resin is preferably in the range of 1 to 20 parts by mass with respect to 100 parts by mass of the polymerizable monomer. As long as the resin is used in an amount within the above range, a sufficient effect of the addition of the resin is obtained, and the ease with which the physical properties of the toner are designed is improved.

In addition, a charge control agent can be incorporated into the toner as required for the purpose of stabilizing the charging characteristic of the toner. Methods of incorporating the charge control agent are classified into a method involving adding the charge control agent into a toner particle and a method involving externally adding the charge control agent. Known charge control agents can be used, but when the charge control agent is internally added, a charge control agent having low polymerization-inhibiting ability and having substantially no product solubilized into an aqueous dispersion medium is particularly preferable. Specific examples of the compound to serve as a negative charge control agent include: metal compounds of aromatic carboxylic acids such as salicylic acid, alkyl salicylic acid, dialkyl salicylic acid, naphthoic acid, and dicarboxylic acid; metal salts or metal complexes of azo dyes or of azo pigments; polymeric compounds each having a sulfonic group or a carboxyl group at a side chain thereof; boron compounds; urea compounds; silicon compounds; and calixarene. Further, specific examples of the compound to serve as a positive charge control agent include: quaternary ammonium salts; polymeric compounds having the quaternary ammonium salts at a side chains; guanidine compounds; nigrosin compounds; and imidazole compounds.

The used amount of any such charge control agent is determined by the method of producing the toner including the kind of the binder resin, the presence or absence of any other additive, and a method of dispersing the additive, so the used amount is not uniquely limited. However, when any such charge control agent is internally added, the charge control agent is used in an amount in the range of preferably 0.1 to 10 parts by mass, or more preferably 0.1 to 5 parts by mass with respect to 100 parts by mass of the binder resin. In addition, when any such charge control agent is externally added, the charge control agent is used in an amount of preferably 0.005 to 1.0 part by mass, or more preferably 0.01 to 0.3 part by mass with respect to 100 parts by mass of the toner particles.

The toner has a weight-average particle diameter (D4) of preferably 3.0 to 10.0 μm in order that an additionally fine latent dot may be faithfully developed, and a high-quality image may be obtained.

Here, the average particle diameter and grain size distribution of the toner can be measured with, for example, a Coulter Counter TA-II model or a Coulter Mtiltisizer (each manufactured by Beckman Coulter, Inc). In the present invention, the Coulter Multisizer was used, and an interface (manufactured by Nikkaki Bios Co., Ltd.) for outputting a number distribution and a volume distribution and a PC9801 personal computer (manufactured by NEC) were connected to it. A 1% aqueous solution of NaCl prepared by using first grade sodium chloride was used as an electrolyte solution.

A measurement method is as described below. 100 to 150 ml of the electrolyte solution are added with 0.1 to 5 ml of a surfactant, preferably an alkylbenzenesulfonate, as a dispersant. Further, 2 to 20 mg of a measurement sample are added to the mixture. Next, the electrolyte solution in which the sample has been suspended is subjected to a dispersion treatment with an ultrasonic dispersing unit for about 1 to 3 minutes. The volumes and number of sample particles each having a particle diameter of 2.0 μm or more are measured by using the Coulter Multisizer with the aide of a 100-μm aperture as an aperture, and the volume distribution and number distribution of the sample are calculated. Then, the weight average particle diameter (D4) and the number average particle diameter (D1) of the sample are determined.

The toner to be obtained by the present invention preferably has an average circularity of −0.970 or more. The average circularity is an indication showing the extent of irregularities of the particles of the toner. When the toner is of a perfect spherical shape, the toner shows an average circularity of 1.000; the more complex the shape of a toner particle surface, the lower a value for the average circularity. That is, an average circularity of 0.970 or more means that the toner is of a substantially spherical shape. A toner having such shape is uniformly charged with ease, and is effective in suppressing fogging or a sleeve ghost. In addition, the spikes of the toner formed on a toner carrying member are uniform, so the spikes can be easily controlled at a developing portion. Further, the toner has good flowability because of its spherical shape, and hardly receives a stress in a developing device, so the charging performance of the toner hardly reduces even when the toner is used for a long time period under a high humidity. In addition, heat or a pressure can be uniformly applied to the entirety of the toner with ease even at the time of fixation, and the ease with which heat or the pressure is uniformly applied contributes to an improvement in fixing performance of the toner.

It should be noted that measurement of the average circularity of the present invention is measured with a flow-type particle image analyzer FPIA-3000 (manufactured by SYSMEX CORPORATION).

A specific measurement method is as described below. After 20 ml of ion-exchanged water had been added with an appropriate amount of a surfactant, preferably alkylbenzenesulfonate, as a dispersant, 0.02 g of a measurement sample were added to the mixture, and the whole was subjected to a dispersion treatment with a desktop ultrasonic cleaning and dispersing machine having an oscillatory frequency of 50 kHz and an electrical output of 150 W (such as "VS-150" (manufactured by VELVO-CLEAR)) for 2 minutes, whereby a dispersion liquid for measurement was obtained. In this case, the dispersion liquid is appropriately cooled so as to have a temperature of 10° C. or higher to 40° C. or lower.

The flow-type particle image analyzer mounted with a standard objective lens (at a magnification of 10) was used for measurement, and a particle sheath "PSE-900A" (manufactured by SYSMEX CORPORATION) was used as a sheath liquid. The dispersion liquid prepared in accordance with the above procedure was introduced into the flow-type particle image analyzer, and 3,000 toner particles were measured according to a total count mode. The average circularity of the toner was determined with particle diameters to be analyzed limited to ones each corresponding to a circle-equivalent diameter of 3.00 μm or more to 200.00 μm or less.

Prior to the initiation of the measurement, automatic focusing is performed by using standard latex particles (obtained by diluting, for example, 5200A manufactured by Duke Scientific with ion-exchanged water). After that, focusing is preferably performed every two hours from the initiation of the measurement.

It should be noted that, in each example of the present application, a flow-type particle image analyzer which had been subjected to a calibration operation by SYSMEX CORPORATION, and which had received a calibration certificate issued by SYSMEX CORPORATION was used, and the measurement was performed under measurement and analysis conditions identical to those at the time of the reception of the calibration certificate except that particle diameters to be analyzed were limited to ones each corresponding to a circle-equivalent diameter of 3.00 μm or more to 200.00 μm or less.

In addition, a flowability-improving agent is preferably externally added to the toner of the present invention for an improvement in quality of an image formed with the toner. Examples of the flowability-improving agent to be suitably used include inorganic fine powders such as a silicate fine powder, titanium oxide, and aluminum oxide. Each of those inorganic fine powders is preferably subjected to a hydrophobic treatment with a hydrophobic agent such as a silane coupling agent, silicone oil, or a mixture thereof.

The toner of the present invention can be used as it is in a one-component developer, or can be used in a two-component developer by being mixed with a magnetic carrier. When the toner is used in a two-component developer, the carrier to be mixed with the toner preferably has a volume-average particle diameter (Dv) of 10 to 100 μm, and the concentration of the toner in the two-component developer is preferably 2 to 15 mass %.

DESCRIPTION OF THE EMBODIMENTS

Hereinafter, the production method of the present invention will be specifically described by way of examples. However, the present invention is by no means limited by these examples.

Example 1

Production of Pigment-Dispersed Paste

| | |
|---|---|
| Styrene: | 78.0 parts by mass |
| Carbon black: | 7.0 parts by mass |

The above materials were sufficiently pre-mixed in a container, and then the mixture was dispersed and mixed with an Attritor (manufactured by Mitsui Miike Machinery Co., Ltd.) for about 4 hours while the temperature of the mixture was kept at 20° C. or lower, whereby a pigment-dispersed paste was produced.

Production of Toner Particles 390 parts by mass of a 0.1-mol/l aqueous solution of $Na_3PO_4$ were charged into 1,150 parts by mass of ion-exchanged water, and the temperature of the mixture was increased to 60° C. while the mixture was stirred. After that, 58 parts by mass of a 1.0-mol/l aqueous solution of $CaCl_2$ were added to the mixture, and the whole was further continuously stirred, whereby an aqueous medium containing a dispersion stabilizer composed of $Ca_3(PO_4)_2$ was prepared.

Meanwhile, the following materials were added to the above pigment-dispersed paste, and the whole was dispersed and mixed with an Attritor (manufactured by Mitsui Miike Machinery Co., Ltd.), whereby a monomer composition was prepared.

| | |
|---|---|
| n-butyl acrylate: | 22.0 parts by mass |
| Divinylbenzene: | 0.1 part by mass |
| Saturated polyester resin (terephthalic acid-propylene oxide-modified bisphenol A polycondensate, MW: 20,000, Tg: 60° C., acid value: 10 mgKOH/g): | 8.0 parts by mass |
| Charge control agent (BONTRON E-84 (Orient Chemical Industries, LTD.)): | 1.0 part by mass |

Saturated polyester resin (terephthalic acid-propylene oxide-modified bisphenol A polycondensate, Mw: 20,000, Tg: 60° C., acid value: 10 mgKOH/g):

8.0 parts by mass

Charge control agent (BONTRON E-84 (Orient Chemical Industries, LTD.)): 1.0 part by mass The temperature of the above monomer composition was increased to 60° C., and 12.0 parts by mass of an ester wax (main component $C_{19}H_{39}COOC_{20}H_{41}$, highest endothermic peak temperature 68.6° C.) were added to, and mixed and dissolved in, the monomer composition.

Next, 6.0 parts by mass of 3-hydroxy-1,1-dimethylbutylperoxyisobutylate as a polymerization initiator were further added to and dissolved in the solution.

The solution was charged into the aqueous medium, and the mixture was granulated at 60° C. under a nitrogen atmosphere under stirring with a CLEAR MIX (manufactured by MTECHNIQUE Co., Ltd.) at 10,000 rpm for 15 minutes.

Further, the resultant suspension was subjected to polymerization at 80° C. for 10 hours while being stirred with a paddle stirring blade. After the completion of the reaction, the suspension was cooled, and hydrochloric acid was added to the suspension to dissolve the dispersion stabilizer. After that, the resultant was filtrated, washed with water, and dried, whereby toner particles were obtained.

Separately, part of the suspension was removed from the reaction vessel every 1 hour from the initiation of the polymerization and after the completion of the polymerization, and a rate of polymerization was determined by measuring the amounts of styrene and n-butyl acrylate remaining in the suspension with a gas chromatography measuring apparatus ("6890N" manufactured by Yokogawa Analytical Systems Inc.). As a result, no polymerization inhibition was found to occur.

The above remaining amounts of styrene and n-butyl acrylate were specifically measured with the above gas chromatography measuring apparatus for a filtrate prepared by: adding acetone in an amount 20 to 50 times as large as that of the removed suspension; treating the mixture with an ultrasonic dispersing unit for about 30 minutes; and filtrating the mixture through a solvent-resistant membrane filter having a pore diameter of 0.5 μm.

Production of Toner 1 part by mass of a hydrophobic silica fine powder which: had been treated with hexamethyldisilazane and silicone oil; and had a number average primary particle diameter of 12 nm and a BET specific surface area of 120 $m^2/g$ was added to 100 parts by mass of the above toner particles, and the whole was mixed with a Henschel mixer (manufactured by Mitsui Miike Machinery Co., Ltd.), whereby a toner was prepared.

Comparative Example 1

A toner was produced in the same manner as in Example 1 except that, in Example 1, 6.4 parts by mass of 3-hydroxy-1,1-dimethylbutylperoxypivalate were used instead of 6.0 parts by mass of 3-hydroxy-1,1-dimethylbutylperoxyisobutylate, and the temperature at the time of the polymerization, 80° C., was reduced to 65° C.

Comparative Example 2

A toner was produced in the same manner as in Example 1 except that, in Example 1, 4.7 parts by mass of t-butylperoxyisobutylate were used instead of 6.0 parts by mass of 3-hydroxy-1,1-dimethylbutylperoxyisobutylate, and the temperature at the time of the polymerization, 80° C., was increased to 94° C.

Comparative Example 3

A toner was produced in the same manner as in Example 1 except that, in Example 1, 5.5 parts by mass of t-amylperoxypivalate were used instead of 6.0 parts by mass of 3-hydroxy-1,1-dimethylbutylperoxyisobutylate, and the temperature at the time of the polymerization, 80° C., was reduced to 70° C.

A rate of polymerization was determined for each of Comparative Examples 1 to 3 from the remaining amounts of styrene and n-butyl acrylate in the same manner as in Example 1. As a result, no polymerization inhibition was found to occur in each of the comparative examples.

It should be noted that the addition amount of the polymerization initiator in each of Comparative Examples 1 to 3 was adjusted so that the amount of active oxygen of the polymerization initiator with respect to the molar amount of a polymerizable monomer in a reaction system might be equal to that of Example 1.

In addition, the polymerization temperature was set to be higher than the 10-hour half life temperature of the polymerization initiator to be used by 15° C. in each case.

Table 1 shows the structures of the polymerization initiators used in Example 1 and Comparative Examples 1 to 3, and Table 2 shows the physical properties of the polymerization initiators.

TABLE 1

| | Polymerization initiator | Structural formula | Number of carbon atoms $R_1$ | $R_2$ | $R_3$ | $R_4$ | Presence or absence of substitution with OH group |
|---|---|---|---|---|---|---|---|
| Example 1 | 3-hydroxy-1,1-dimethylbutylperoxy isobutylate | 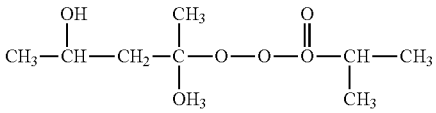 | 3 | 3 | 1 | 1 | Present |
| Comparative Example 1 | 3-hydroxy-1,1-dimethylbutylperoxy-pivalate | 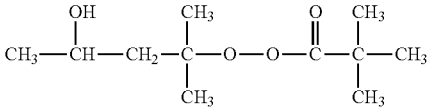 | 3 | 4 | 1 | 1 | Present |
| Comparative Example 2 | t-butylperoxyisobutylate | 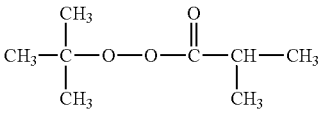 | 1 | 3 | 1 | 1 | Absent |
| Comparative Example 3 | t-amylperoxypivalate | 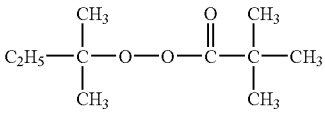 | 2 | 4 | 1 | 1 | Absent |

(Note)

The number of carbon atoms shows the number of carbon atoms at each of $R_1$ to $R_4$ in the general formula (I), and the presence or absence of substitution with an OH group shows the presence or absence of substitution with an OH group at $R_1$ in the general formula (I).

TABLE 2

| | Molecular weight | 10-hour half life temperature (° C.) | Hydrogen bond dissociation energy (kJ/mol) D1 | D2 | D3 | Energy difference (kJ/mol) D1 − D2 | \|D2 − D3\| |
|---|---|---|---|---|---|---|---|
| Example 1 | 204 | 65 | 464 | 372 | 348 | 92 | 24 |
| Comparative Example 1 | 218 | 50 | 464 | 372 | 329 | 92 | 43 |
| Comparative Example 2 | 160 | 79 | 465 | 386 | 348 | 79 | 38 |
| Comparative Example 3 | 188 | 55 | 467 | 367 | 329 | 100 | 38 |

(Note)

D1 to D3 each represent the hydrogen bond dissociation energies of the following compounds:

TABLE 2-continued

D1: an alcohol produced by the thermal decomposition of a polymerization initiator;

D2: a compound in which $R_1$ in the general formula (I) and hydrogen are bonded to each other; and D3: a compound in which $R_2$ in the general formula (I) and hydrogen are bonded to each other.

Possible decomposition products derived from the respective polymerization initiators used in Example 1 and Comparative Examples 1 to 3 include: 2-methylpentane-2,4-diol, t-butyl alcohol, or t-amyl alcohol as a by-product produced by the abstraction of hydrogen by an alkoxy radical; and isobutyric acid or pivalic acid as a by-product produced by the abstraction of hydrogen by an acyloxy radical. Each of those alcohols and carboxylic acids has high water-solubility, so, when any one of them is produced, the produced alcohol or carboxylic acid may be easily eluted in a dispersion medium.

In view of the foregoing, for each of Example 1 and Comparative Examples 1 to 3, on the assumption that all the above alcohols and the above carboxylic acids were each eluted in a dispersion medium, the degree of alcohol conversion of alkoxy radicals was calculated from the amount of an alcohol in the dispersion medium after the completion of polymerization, and the degree of carboxylic acid conversion of acyloxy radicals was calculated from the amount of a carboxylic acid in the dispersion medium after the completion of the polymerization. Then, the ratio at which a polymerization initiator was utilized was determined from those values as described below.

<Degree of Alcohol Conversion, Degree of Carboxylic Acid Conversion, and Ratio at which Polymerization Initiator is Utilized>

First, after the completion of polymerization, part of slurry was removed from a reaction vessel and filtrated through a solvent-resistant membrane filter having a pore diameter of 0.5 μm. After that, the concentrations of an alcohol and a carboxylic acid in the filtrate were measured with a gas chromatography measuring apparatus ("6890N" manufactured by Yokogawa Analytical Systems Inc.). Then, the amount of the alcohol and the amount of the carboxylic acid were determined from the resultant concentrations by calculation.

A degree of alcohol conversion and a degree of carboxylic acid conversion were each determined from the amount of the alcohol or the amount of the carboxylic acid determined in the foregoing and the amount of the polymerization initiator used by using the following equation.

Degree of conversion (%)=[amount (mole) of alcohol or carboxylic acid/amount (mole) of polymerization initiator]×100

In addition, the ratio at which a radical was utilized was calculated from the values for the degree of alcohol conversion and the degree of carboxylic acid conversion thus obtained by using the following equation, and was defined as the ratio at which the polymerization initiator was utilized.

Utilization ratio (%)=[(100−degree of alcohol conversion)+(100−degree of carboxylic acid conversion)]/2

Table 3 shows the results.

TABLE 3

| | Degree of alcohol conversion of alkoxy radicals (%) | Degree of carboxylic acid conversion of acyloxy radicals (%) | Ratio at which polymerization initiator is utilized (%) |
|---|---|---|---|
| Example 1 | 6 | 8 | 93 |
| Comparative Example 1 | 29 | 3 | 84 |
| Comparative Example 2 | 76 | 2 | 61 |
| Comparative Example 3 | 52 | 2 | 73 |

As is apparent from Table 3, in the example of the present invention, both the degree of alcohol conversion of the alkoxy radicals and the degree of acid conversion of the acyloxy radicals are low, and the ratio at which the polymerization initiator is utilized is extremely high.

In contrast, the following was found: in each of the comparative examples, the degree of carboxylic acid conversion of the acyloxy radicals was low, but most of the alkoxy radicals were converted into alcohols without being utilized, with the result that the ratio at which the polymerization initiator was utilized reduced.

Next, the weight-average particle diameter (D4), number average particle diameter (D1), average circularity, and molecular weight (main peak molecular weight Mp) of each of the toners obtained in Example 1 and Comparative Examples 1 to 3 were measured. Table 4 shows the results. It should be noted that the methods of measuring the average particle diameters and the average circularity are as described above. In addition, the molecular weight was measured with a gel permeation chromatography (GPC) measuring apparatus manufactured by TOSOH CORPORATION (HLC-8120GPC) as described below.

<Measurement of Main Peak Molecular Weight (Mp)>

First, a sample is immersed in tetrahydrofuran (THF), and the whole is subjected to such extraction that the concentration of a resin component is 0.05 to 0.6 mass %. The extract is filtrated through a solvent-resistant membrane filter having a pore diameter of 0.5 μm, whereby a sample solution is prepared. Next, a column is stabilized in a heat chamber at 40° C. THF as a solvent is flowed into the column at the temperature at a flow rate of 1 ml/min, and 50 to 200 μl of the above sample solution are injected for measurement.

In calculating the molecular weight of the sample, the molecular weight distribution possessed by the sample is determined from a relationship between a logarithmic value of an analytical curve prepared by several kinds of monodisperse polystyrene standard samples, and the number of counts. Examples of standard polystyrene samples for preparing an analytical curve that can be used include samples manufactured by Pressure Chemical Co. or by TOSOH CORPORATION each having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, or $4.48\times10^6$. At least about ten standard polystyrene samples are suitably used. In addition, a refractive index (RI) detector is used as a detector. Note that, it is recommended that a combination of multiple commercially available polystyrene gel columns be used as the column for accurately measuring a molecular weight region of $10^3$ to $2\times10^6$. In the present invention, the following condition is employed for the measurement.

Column: KF801, 802, 803, 804, 805, 806, 807 (manufactured by Shodex)

Column Temperature: 40° C.

solv.: THF

TABLE 4

| | Weight-average particle diameter (μm) | Number average particle diameter (μm) | Weight-average particle diameter/Number average particle diameter | Average circularity | Molecular weight (Mp) |
|---|---|---|---|---|---|
| Example 1 | 6.4 | 5.5 | 1.16 | 0.986 | 32700 |
| Comparative Example 1 | 6.8 | 5.1 | 1.33 | 0.978 | 38800 |
| Comparative Example 2 | 6.9 | 5.2 | 1.33 | 0.974 | 41200 |
| Comparative Example 3 | 6.8 | 5.2 | 1.30 | 0.976 | 39300 |

As is apparent from Table 4, the toner according to the example of the present invention has a sharper grain size distribution and a higher circularity than those of each of the toners of the comparative examples, and shows a lower molecular weight (Mp) than that of each of the toners of the comparative examples.

Such difference in grain size distribution or circularity between the toner of the example and each of the toners of the comparative examples may result from the following fact: in each of the comparative examples, a large amount of an alcohol was produced and eluted, so granulation stability was impaired, and the ease with which emulsified particles were produced was improved. In addition, the difference in main peak molecular weight (Mp) between the toner of the example and each of the toners of the comparative examples may result from an increase in efficiency with which the polymerization initiator was utilized in the example of the present invention.

Example 2

A toner was produced in the same manner as in Example 1 except that, in Example 1, 6.8 parts by mass of 3-hydroxy-1 μl-dimethylbutylperoxy-2-ethylbutylate were used instead of 6.0 parts by mass of 3-hydroxy-1,1-dimethylbutylperoxyisobutylate, and the temperature at the time of the polymerization, was changed to 81° C.

Comparative Example 4

A toner was produced in the same manner as in Example 1 except that, in Example 1, 5.5 parts by mass of t-hexylperoxyisobutylate were used as a polymerization initiator instead of 6.0 parts by mass of 3-hydroxy-1,1-dimethylbutylperoxyisobutylate, and the temperature at the time of the polymerization, 80° C., was increased to 90° C.

Comparative Example 5

The toner of the comparative example was produced in the same manner as in Example 1 except that, in Example 1, 6.4 parts by mass of 1,1,3,3-tetramethylbutylperoxyisobutylate were used instead of 6.0 parts by mass of 3-hydroxy-1,1-dimethylbutylperoxyisobutylate, and the temperature at the time of the polymerization, 80° C., was reduced to 73° C.

Comparative Example 6

The toner of the comparative example was produced in the same manner as in Example 1 except that, in Example 1, 6.4 parts by mass of t-butylperoxy-2-ethylhexanoate were used instead of 6.0 parts by mass of 3-hydroxy-1,1-dimethylbutylperoxyisobutylate, and the temperature at the time of the polymerization, 80° C., was increased to 88° C.

Comparative Example 7

The toner of the comparative example was produced in the same manner as in Example 1 except that, in Example 1, 7.2 parts by mass of t-hexylperoxy-2-ethylhexanoate were used instead of 6.0 parts by mass of 3-hydroxy-1,1-dimethylbutylperoxyisobutylate, and the temperature at the time of the polymerization, 80° C., was increased to 85° C.

Comparative Example 8

The toner of the comparative example was produced in the same manner as in Example 1 except that, in Example 1, 7.6 parts by mass of 3-hydroxy-1,1-dimethylbutylperoxy-2-ethylhexanoate were used instead of 6.0 parts by mass of 3-hydroxy-1,1-dimethylbutylperoxyisobutylate, and the temperature at the time of the polymerization, was changed to 81° C.

A rate of polymerization was determined for each of Example 2 and Comparative Examples 4 to 8 from the remaining amounts of styrene and n-butyl acrylate in the same manner as in Example 1. As a result, no polymerization inhibition was found to occur in each of the example and the comparative examples.

It should be noted that the addition amount of the polymerization initiator in each of Example 2 and Comparative Examples 4 to 8 was adjusted so that the amount of active oxygen of the polymerization initiator with respect to the molar amount of a polymerizable monomer in a reaction system might be equal to that of Example 1.

In addition, the polymerization temperature was set to be higher than the 10-hour half life temperature of the polymerization initiator to be used by 15° C. in each case.

Table 5 shows the structures of the polymerization initiators used in Example 2 and Comparative Examples 4 to 8, and Table 6 shows the physical properties of the polymerization initiators.

TABLE 5

| | Polymerization initiator | Structural formula | Number of carbon atoms $R_1$ | $R_2$ | $R_3$ | $R_4$ | Presence or absence of substitution with OH group |
|---|---|---|---|---|---|---|---|
| Example 2 | 3-hydroxy-1,1-dimethylbutyl-peroxy-2-ethylbutylate | 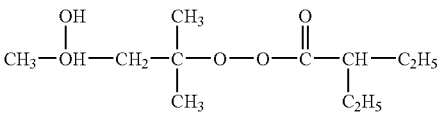 | 3 | 5 | 1 | 1 | Present |
| Comparative Example 4 | t-hexylperoxyisobutylate | 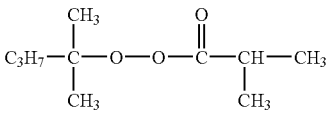 | 3 | 3 | 1 | 1 | Absent |
| Comparative Example 5 | 1,1,3,3-tetramethylbutylperoxy-isobutylate | 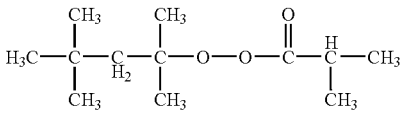 | 5 | 3 | 1 | 1 | Absent |
| Comparative Example 6 | t-butylperoxy-2-ethylhexanoate | 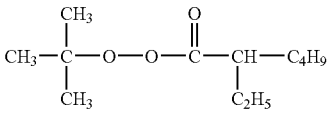 | 1 | 7 | 1 | 1 | Absent |

TABLE 5-continued

| | Polymerization initiator | Structural formula | Number of carbon atoms $R_1$ | $R_2$ | $R_3$ | $R_4$ | Presence or absence of substitution with OH group |
|---|---|---|---|---|---|---|---|
| Comparative Example 7 | t-hexylperoxy-2-ethylhexanoate | 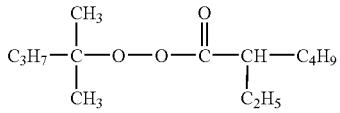 | 3 | 7 | 1 | 1 | Absent |
| Comparative Example 8 | 3-hydroxy-1,1-dimethyl-butylperoxy-2-ethyl-hexanoate | 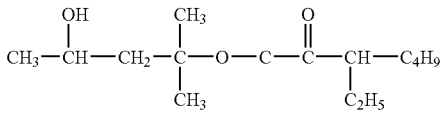 | 3 | 7 | 1 | 1 | Present |

(Note) The number of carbon atoms shows the number of carbon atoms at each of R1 to R4 in the general formula (I), and the presence or absence of substitution with an OH group shows the presence or absence of substitution with an OH group at R1 in the general formula (I).

TABLE 6

| | Molecular weight | 10-hour half life temperature (° C.) | Hydrogen bond dissociation energy (kJ/mol) D1 | D2 | D3 | Energy difference (kJ/mol) D1 − D2 | \|D2 − D3\| |
|---|---|---|---|---|---|---|---|
| Example 2 | 232 | 66 | 464 | 372 | 351 | 92 | 21 |
| Comparative Example 4 | 188 | 75 | 465 | 368 | 348 | 97 | 20 |
| Comparative Example 5 | 216 | 58 | 464 | 372 | 348 | 92 | 24 |
| Comparative Example 6 | 216 | 73 | 465 | 386 | 352 | 79 | 34 |
| Comparative Example 7 | 244 | 70 | 465 | 368 | 352 | 97 | 16 |
| Comparative Example 8 | 260 | 66 | 464 | 372 | 352 | 92 | 20 |

(Note)
D1 to D3 each represent the hydrogen bond dissociation energies of the following compounds:
D1: an alcohol produced by the thermal decomposition of a polymerization initiator;
D2: a compound in which $R_1$ in the general formula (I) and hydrogen are bonded to each other; and
D3: a compound in which $R_2$ in the general formula (I) and hydrogen are bonded to each other.

Next, the weight-average particle diameter (D4), number average particle diameter (D1), average circularity, and peak molecular weight (Mp) of each of the toners obtained in Example 2 and Comparative Examples 4 to 8 were measured. Table 7 shows the results. It should be noted that the methods of measuring those parameters are as described above.

TABLE 7

| | Weight-average particle diameter (μm) | Number average particle diameter (μm) | Weight-average particle diameter/Number average particle diameter | Average circularity | Molecular weight (Mp) |
|---|---|---|---|---|---|
| Example 2 | 6.4 | 5.4 | 1.19 | 0.984 | 32800 |
| Comparative Example 4 | 6.6 | 5.3 | 1.24 | 0.980 | 36500 |

TABLE 7-continued

| | Weight-average particle diameter (μm) | Number average particle diameter (μm) | Weight-average particle diameter/Number average particle diameter | Average circularity | Molecular weight (Mp) |
|---|---|---|---|---|---|
| Comparative Example 5 | 6.7 | 5.2 | 1.29 | 0.976 | 37600 |
| Comparative Example 6 | 6.8 | 5.0 | 1.36 | 0.974 | 38700 |
| Comparative Example 7 | 6.7 | 5.2 | 1.29 | 0.978 | 37200 |
| Comparative Example 8 | 6.6 | 5.4 | 1.22 | 0.982 | 34500 |

As is apparent from Table 7, the toners of the examples according to the present invention each have a sharp grain size distribution and a high circularity, and each show a low main peak molecular weight (Mp). Of those toners, the toner of Example 2 using a polymerization initiator obtained by introducing a hydroxyl group into the $R_1$ group shows a particularly good value.

Such difference in grain size distribution or circularity between the toner of the example and each of the toners of the comparative examples suggests that, in Example 2 as well, the production of an alcohol was suppressed, and the ratio at which the polymerization initiator was utilized was improved.

Further, each of the toners obtained in Examples 1 and 2, and Comparative Examples 4 to 8 was subjected to an image output test by the following method.

<Image Output Test>

A reconstructed device of a commercially available full-color laser beam printer (LBP-2040, manufactured by Canon Inc.) was used as a testing machine. The process cartridge of the reconstructed device was loaded with toner, and images were output on 5,000 sheets under a normal-temperature, normal-humidity environment (23° C., 60% RH) according to a monochromatic mode at a print speed of 16 sheets/min (A4-size paper) while the process cartridge was sequentially replenished with the toner as required.

Solid images were output at the initial stage of the image output and after duration by using ordinary plain paper for a copying machine (75 g/m$^2$) as a transfer material, and their image densities were measured.

It should be noted that the image densities were each measured as a density relative to that of an image at a white portion having a manuscript density of 0.00 with a "Macbeth reflection densitometer RD918" (manufactured by Macbeth Co.).

In addition, after the 5,000-sheet image output, a toner carrying member was removed from the reconstructed device, and the toner was wiped off the toner carrying member. After that, the contaminated state of the surface of the toner carrying member was observed with a microscope, and was evaluated on the basis of the following criteria. Table 8 shows the results of the evaluation.

A: No particular contamination is observed.
B: The melt adhesion of the toner is slightly observed.
C: The melt adhesion of the toner is observed.
D: The melt adhesion of the toner is remarkably observed.

TABLE 8

| | Image density | | Contaminated state |
|---|---|---|---|
| | Initial stage | After 5,000-sheet image output | of surface of toner carrying member |
| Example 1 | 1.49 | 1.48 | A |
| Example 2 | 1.48 | 1.46 | A |
| Comparative Example 4 | 1.46 | 1.42 | B |
| Comparative Example 5 | 1.47 | 1.36 | C |
| Comparative Example 6 | 1.44 | 1.32 | D |
| Comparative Example 7 | 1.46 | 1.36 | D |
| Comparative Example 8 | 1.46 | 1.39 | C |

As is apparent from Table 8, the toners of the examples according to the present invention each have a good image density from the initial stage of the image output test, and each maintain the image density even after the images have been printed out on the 5,000 sheets. In addition, no contamination on the surface of the toner carrying member was observed when each of the toners of the examples according to the present invention was used.

On the other hand, each of the toners of the comparative examples had a low image density from the initial stage of the image output test, and, in particular, showed a significant reduction in image density in association with an increase in number of durable sheets. Further, a deposit was observed on the surface of the toner carrying member after the images had been printed out on the 5,000 sheets. Those results suggested that the performance of each of the toners of the comparative examples was affected by a high-molecular-weight by-product from an alkoxy radical or acyloxy radical as a decomposition product residue.

Example 3

Production of Binder Resin for Toner

An aqueous medium was prepared by dissolving 0.2 part by mass of polyvinyl alcohol in 300 parts by mass of ion-exchanged water. Meanwhile, 78.0 parts by mass of styrene, 22.0 parts by mass of n-butyl acrylate, and 2.5 parts by mass of 3-hydroxy-1,1-dimethylbutylperoxyisobutylate used in Example 1 as a polymerization initiator were mixed, whereby a monomer composition was prepared. The monomer composition was loaded into the aqueous medium, and the mixture was stirred with a TK-homomixer (manufactured by Tokushu Kika Kogyo) for 15 minutes, whereby a suspended dispersion liquid was prepared. Under a nitrogen atmosphere, the temperature of the above suspended dispersion liquid was increased to 85° C., and polymerization was initiated. Further, the liquid was held at the temperature for 24 hours, and a polymerization reaction was completed. After the completion of the reaction, the suspended dispersion liquid was cooled, separated by filtration, washed with water, and dried, whereby a styrene/n-butyl acrylate copolymer was obtained.

In addition, part of slurry was removed from a reaction vessel after the completion of the reaction, and a degree of alcohol conversion, a degree of carboxylic acid conversion, and the ratio at which the polymerization initiator was utilized were each calculated by the above-mentioned method. Table 9 shows the results.

Preparation of Toner:

7.0 parts by mass of copper phthalocyanine (Pigment Blue 15:3), 1.0 part by mass of a nigrosine compound, and 3.0 parts by mass of a paraffin wax (having a local maximum value for the highest endothermic peak in DSC at 74° C.) were added to 100.0 parts by mass of the styrene/n-butyl acrylate copolymer, and the whole was mixed with a Henschel mixer.

Next, the mixture was melted and kneaded with a biaxial kneading extruder heated to 130° C. The kneaded product was cooled and coarsely pulverized with a hammer mill. The coarsely pulverized products were finely pulverized with a Jet Mill (manufactured by Nippon Pneumatic Mfg. Co., Ltd.). After that, the resultant finely pulverized products were classified with an air classifier, whereby toner particles were obtained.

1 part by mass of a hydrophobic silica fine powder which: had been treated with hexamethyldisilazane and silicone oil; and had a number average primary particle diameter of 12 nm and a BET specific surface area of 120 $m^2/g$ was added to 100 parts by mass of the above toner particles, and the whole was mixed with a Henschel mixer (manufactured by Mitsui Miike Machinery Co., Ltd.), whereby a toner was prepared. The resultant toner had a weight-average particle diameter (D4) of 10.8 μm and an average circularity of 0.928.

The resultant toner was subjected to an image output test in the same manner as in Example 1, and was evaluated in the same manner as in Example 1. Table 10 shows the results of the evaluation.

TABLE 9

| | Degree of alcohol conversion of alkoxy radicals (%) | Degree of carboxylic acid conversion of acyloxy radicals (%) | Ratio at which polymerization initiator is utilized (%) |
|---|---|---|---|
| Example 3 | 4 | 6 | 95 |

TABLE 10

| | Image density | | Contaminated state |
|---|---|---|---|
| | Initial stage | After 5,000-sheet image output | of surface of toner carrying member |
| Example 3 | 1.40 | 1.36 | A |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-062110, filed Mar. 12, 2007, which is hereby incorporated by reference herein in its entirety.

What is claimed is:

1. A method of producing polymerized toner comprising;

dispersing a polymerizable monomer composition containing at least a polymerizable monomer and a carbon black in an aqueous medium, and polymerizing the polymerizable monomer in the aqueous medium with a polymerization initiator, wherein:

the polymerization initiator has a structure represented by the following general formula (I); and when a hydrogen bond dissociation energy per one mole of an alcohol represented by the following general formula (II) produced by decomposition of the polymerization initiator is represented by D1 (kJ/mol), a hydrogen bond dissociation energy per one mole of a compound represented by the following general formula (III) in which $R_1$ in the following general formula (I) and hydrogen are bonded to each other is represented by D2 (kJ/mol), and a hydrogen bond dissociation energy per one mole of a compound represented by the following general formula (IV) in which $R_2$ in the following general formula (I) and hydrogen are bonded to each other is represented by D3 (kJ/mol), D1 to D3 satisfy relationships represented by the following expressions (i) and (ii):

$$D1-D2 \geq 85 \text{ kJ/mol; and} \quad \text{(i)}$$

$$|D2-D3| \leq 30 \text{ kJ/mol;} \quad \text{(ii)}$$

General formula (I)

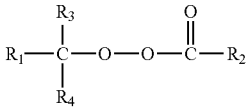

where $R_1$ represents a group obtained by substituting part of hydrogen atoms of a hydrocarbon group having 1 to 6 carbon atoms with hydroxyl groups, $R_2$ represents a hydrocarbon group having 1 to 6 carbon atoms, and $R_3$ and $R_4$ each represent a hydrocarbon group having 1 or 2 carbon atoms, General formula (II)

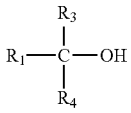

General formula (III)

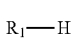

General formula (IV)

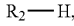

and wherein the polymerization inhibitor is selected from the group consisting of 3-hydroxy-1,1-dimethylbutylperoxy-2-ethylbutylate,
3-hydroxy-1,1-dimethylpropylperoxy-2-ethylbutylate,
3-hydroxy-1,1-dimethylpentylperoxy-2-ethylbutylate,
3-hydroxy-1,1-diethylbutylperoxy-2-ethylbutylate,
3-hydroxy-1,1-diethylpropylperoxyisobutylate,
3-hydroxy-1,1-diethylpropylperoxy-2-ethylbutylate,
3-hydroxy-1,1-diethylpentylperoxyisobutylate,
3-hydroxy-1,1-diethylpentylperoxy-2-ethylbutylate,
3-hydroxy-1-methyl-1-ethylbutylperoxyisobutylate,
3-hydroxy-1-methyl-1-ethylbutylperoxy-2-ethylbutylate,
3-hydroxy-1-methyl-1-ethylpentylperoxyisobutylate, and
3-hydroxy-1-methyl-1-ethylpentylperoxy-2-ethylbutylate.

2. A method of producing polymerized toner according to claim 1, wherein the polymerization initiator is used in an amount of 0.5 to 20 parts by mass with respect to 100 parts by mass of the polymerizable monomer.

3. The method of producing polymerized toner according to claim 1, wherein the polymerization inhibitor is used in an amount of 6.0 to 6.8 parts by mass with respect to 100 parts by mass of the polymerizable monomer.

4. The method of producing polymerized toner according to claim 1, wherein the carbon black is used in an amount of 1 to 20 parts by mass with respect to 100 parts by mass of the polymerizable monomer.

* * * * *